US006782855B1

(12) United States Patent
Albertson et al.

(10) Patent No.: US 6,782,855 B1
(45) Date of Patent: Aug. 31, 2004

(54) VALVE TRAIN AND METHOD FOR REDUCING OIL FLOW TO DEACTIVATED ENGINE VALVES

(75) Inventors: William C. Albertson, Clinton Township, MI (US); Frederick J. Rozario, Fenton, MI (US); David R. Staley, Flushing, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/437,540

(22) Filed: May 14, 2003

(51) Int. Cl.[7] ..... F01M 1/06

(52) U.S. Cl. ..... 123/90.33; 123/90.36; 123/90.61; 123/90.16; 123/198 F

(58) Field of Search ..... 123/90.33–90.38, 123/90.61, 198 F, 90.16, 90.31, 196 CP, 196 M

(56) References Cited

U.S. PATENT DOCUMENTS 1,792,836 A * 2/1931 Handwerker ..... 123/90.36
2,676,579 A * 4/1954 Gerner ..... 123/90.57
4,883,027 A * 11/1989 Oikawa et al. ..... 123/90.16
5,394,843 A * 3/1995 Decuir ..... 123/90.39
5,992,362 A * 11/1999 Helmin ..... 123/90.63
6,227,160 B1 * 5/2001 Kurihara et al. ..... 123/196 R

* cited by examiner

*Primary Examiner*—Thomas Denion
*Assistant Examiner*—Kyle M. Riddle
(74) *Attorney, Agent, or Firm*—Leslie C. Hodges

(57) ABSTRACT

An engine valve train has oil flow to valve actuating components cut off or restricted when the valves are closed, to reduce parasitic losses. In an exemplary embodiment, a pushrod has a pivotable connection with a valve actuating rocker arm through which internal oil passages conduct oil for lubricating the rocker arm. The passages are aligned during valve actuation but become misaligned when the valve is closed. Misalignment of the passages at the sliding connection reduces the amount of oil flow through the connection to improve engine efficiency. When applied to cylinder deactivation engines, oil flow to rocker arms of deactivated valves is completely cut off, or reduced, further reducing parasitic losses.

6 Claims, 2 Drawing Sheets

VALVE TRAIN AND METHOD FOR REDUCING OIL FLOW TO DEACTIVATED ENGINE VALVES

TECHNICAL FIELD

This invention relates to engine valve trains and lubrication systems.

BACKGROUND OF THE INVENTION

It is known in the art to lubricate the components of engine valve trains to control wear of the relatively moving parts. Commonly, pressure lubrication is utilized, although some systems rely on oil spray or mist. It is also known to use pressurized lubricant to operate control devices, such as switching lifters for valve deactivation and cam phasers for varying valve timing. These devices may require increasing lubricant flow or maintaining prescribed oil pressure to assure their proper operation. However, it is desired to limit requirements for increased oil flow and pressure to avoid parasitic losses in the lubricant system that reduce overall engine efficiency.

SUMMARY OF THE INVENTION

The present invention provides a modified valve train for an internal combustion engine which improves engine efficiency by selectively reducing the flow of lubricating oil to the nonmoving parts of the valve train during cylinder deactivation.

Definitions: As used in the following summary, description, claims and abstract, the term pivot and its related terms, such as pivoting, pivotally, pivotable, etc. are intended to refer exclusively to oscillating motion of a member, such as a rocker arm, or a joint, such as a push rod to rocker arm connection as shown in the drawings illustrating the present invention and as these terms are commonly used in reference to such valve train components. Where a rotational joint or motion is intended, the term rotate and variations thereof are utilized to distinguish from oscillatory pivoting motion as referred to above.

Under normal operating conditions, oil is pumped through the engine to provide lubrication for all of the moving components of the valve train. Cylinder deactivation may be accomplished by switching valve lifters which are operated to selectively stop actuation of the intake and exhaust valves of the deactivated cylinders. This invention stems from the recognition that stopping or reducing lubrication to the nonmoving components in the valve train during cylinder deactivation can reduce parasitic losses from excess lubricant flow while continuing to provide necessary lubrication to the valve train when the cylinders are again activated.

In a preferred embodiment, the valves are actuated by cam following switching lifters connected through hollow pushrods with rocker arms that actuate the valves. Oil from the lifters is delivered through a pivotable connection between the pushrods and the rocker arms. Openings in the connection are misaligned when the valves are closed to limit or cut off oil flow. Opening of the valves aligns the openings to provide oil flow to the rocker arms when the valves are opening and closing.

Cutting off or limiting oil flow to the rocker arms when the valves are closed significantly reduces parasitic oil flow in the lubrication system and thereby increases engine efficiency. The arrangement not only limits oil flow to the rocker arms of deactivated cylinders but also limits (or cuts off) oil flow to the rocker arms of active cylinders when their valves are closed, allowing full lubrication flow only when the valve are being opened and closed. Thus, the invention can be used to increase lubrication system efficiency in engines without cylinder deactivation as well as in those having this feature.

These and other features and advantages of the invention will be more fully understood from the following description of certain specific embodiments of the invention taken together with the accompanying drawings.

DESCRIPTION OF THE PREFERRED EMBODIMENT

Figure 1:
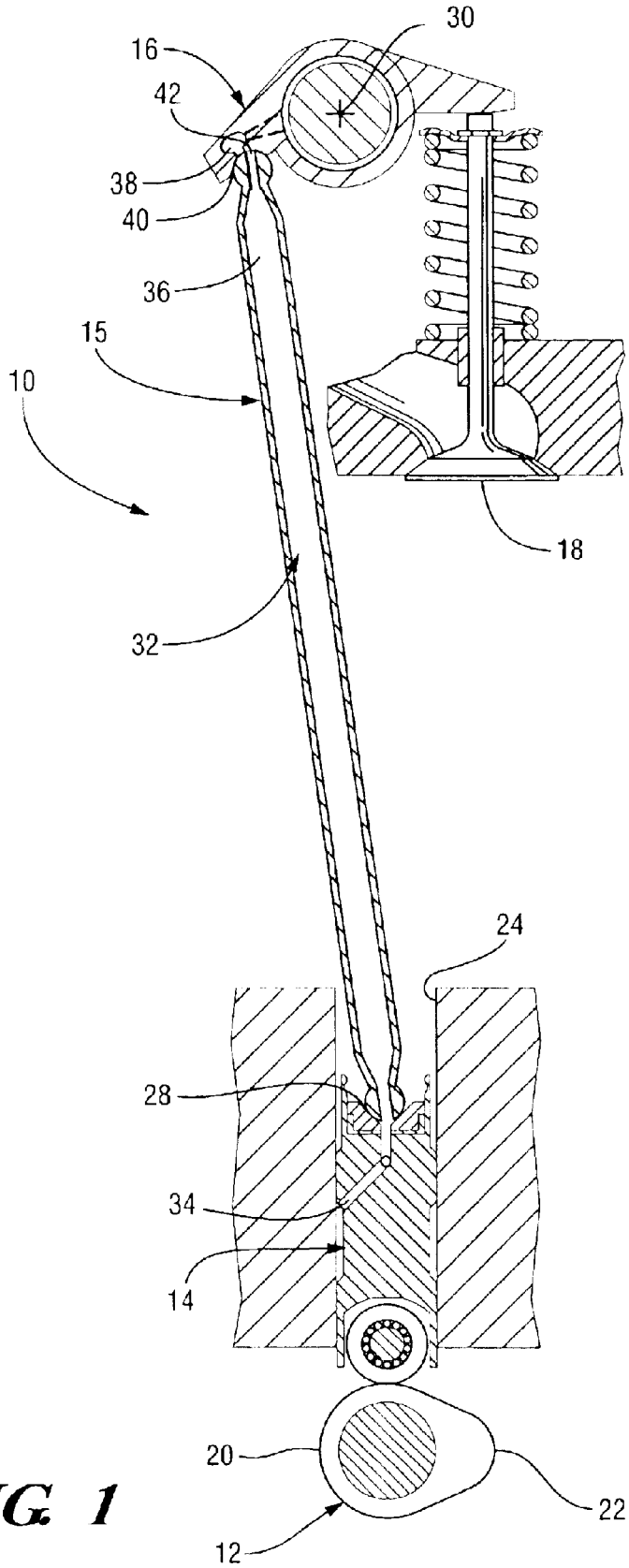
FIG. 1 is a cross-sectional view of a valve train assembly according to the present invention showing the valve in the closed position.
Figure 2:
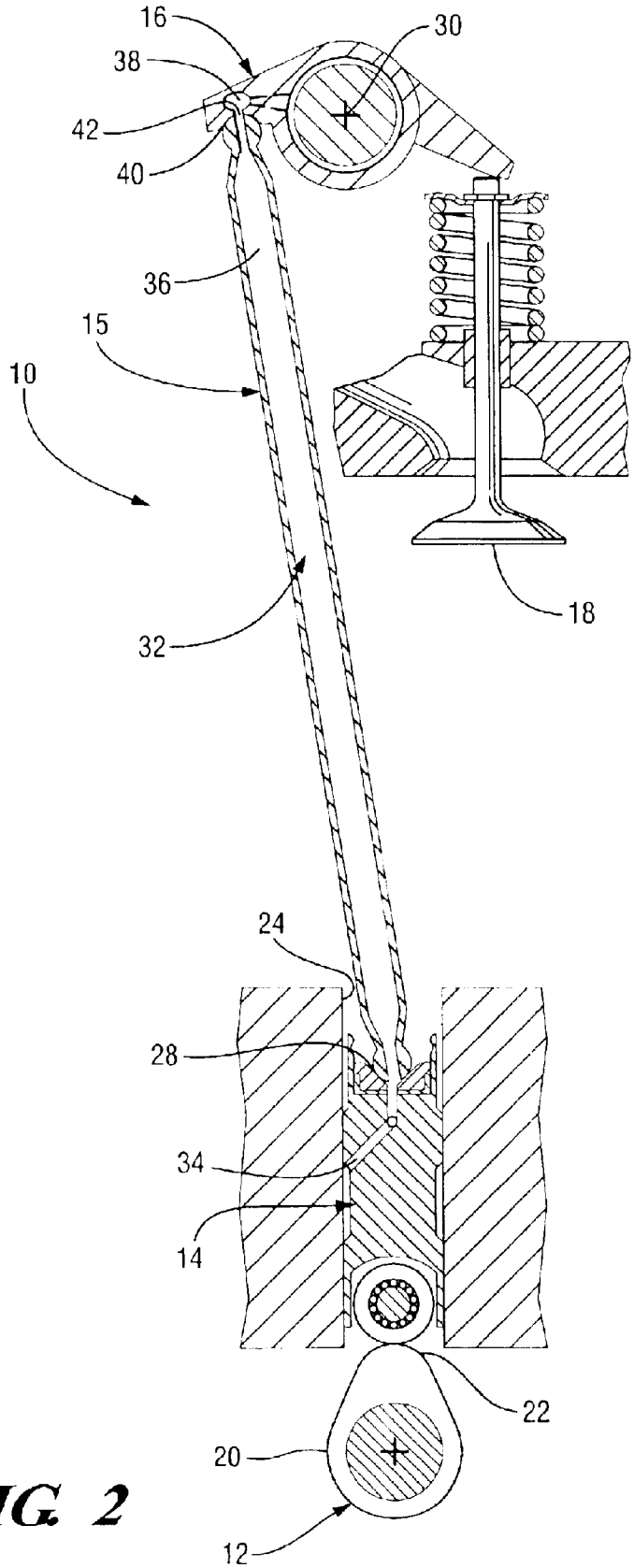
FIG. 2 is a cross-sectional view of the valve train of FIG. 1 showing the valve in the open position.

Referring now to FIGS. 1 and 2 of the drawings in detail, numeral 10 generally shows a valve train including a rotatable camshaft 12, engaging a reciprocable cam follower 14, a pushrod 15 and a rocker arm 16, pivotally actuatable by the cam follower 14 and pushrod 15 to actuate a valve 18. The valve 18 may be either an intake or exhaust valve. The cam follower shown is a switching valve lifter which is operable to deactivate valve actuation in response to an oil pressure signal, as is known in the art.

The camshaft 12 includes a base circle 20 and a lobe 22 extending from the base circle 20. As the cam 12 rotates, the lobe 22 lifts the cam follower 14 inside a guide 24 of a lifter gallery 25. Reciprocation of the cam follower 14 reciprocates the pushrod 15. The pushrod 15 has a spherical connection 28 with the cam follower 14 and the rocker arm 16 as well as a pivotable connection with the rocker arm. As the pushrod 15 reciprocates, the rocker arm 16 pivots about a rocker shaft 30. As the rocker arm 16 pivots, the valve 18 engaged by the arm 16 opens and closes.

A series of oil passages 32 lubricate the assembly 10. The interior of the cam follower 14 defines an oil passage 34, which receives oil for operating the lash adjuster and valve deactivation functions of the switching valve lifter contained in the cam follower and also for lubricating the pushrods 15 and rocker arm 16. The interior of the pushrod 15 defines an oil passage 36 which extends longitudinally through the pushrod 15 and conducts pressurized oil from the oil passage 34 of the cam follower 14 to an oil passage 38 in the rocker arm 16, which lubricates the rocker arm pivot action on the rocker shaft 30. A pivoting connection 40, between the pushrod 15 and the rocker arm 16, also creates a lubrication connection 42, which controls oil flow from the oil passage 36 of the pushrod 15 to the oil passage 38 of the rocker arm 16.

In accordance with the present invention, the lubrication connection 42 between the rocker arm 16 and the pushrod 15 is a pivotable connection. The connection 42 may resemble a ball and socket or any other type of pivotable connection. The lubrication connection 42 between the rocker arm 16 and the pushrod 15 regulates the amount of oil flow to the rocker arm 16 by varying alignment of the pushrod oil passage 36 with the rocker oil passage 38 at the lubrication connection 42.

FIG. 1 shows complete misalignment of oil passages 36, 38 when the rocker arm 16 is in the valve closed position.

When oil passages 36, 38 are completely misaligned, the flow of oil to the rocker arm 16 is cut off. The degree of misalignment in the closed position may be made less severe than shown in FIG. 1 in order to maintain minimal oil flow through the valve train 10.

FIG. 2 shows full alignment of oil passages 36, 38 during the open valve position. The aligned oil passages 36, 38 allow the maximum amount of oil to flow into rocker arm 16.

In operation, the camshaft 12 rotates to actuate components of the valve train 10. Rotation of the camshaft 12 causes the lobe 22 to contact the follower 14. The lobe 22 lifts the follower 14 to the valve open position and then lowers the follower to the cam base circle 20, causing the follower 14 to remain stationary until the lobe 22 reengages the follower 14. The lifting motion of the cam follower 14 actuates the pushrod 15 which, in turn, pivots the rocker arm 16 and opens the valve.

In the valve closed position, oil passages 36, 38 are partially or fully misaligned to reduce or cut off oil flow to the rocker arm 16. As the rocker arm 16 is actuated to open the valve 18, the connection 42 between oil passages 36, 38 aligns, allowing oil to flow freely from the pushrod 15 into the rocker arm 16. As the rocker arm 16 pivots back to the closed position, to close valve 18, the connection 42 between oil passages 36, 38 again becomes misaligned to cut off or reduce the flow of oil to the rocker arm 16.

During engine operation on all cylinders, all of the valves operate during each cycle, allowing a consistent flow of oil through the assemblies of the valve train. The flow is shut off or restricted to each rocker arm when its valve is closed. Thus, oil flows to a rocker arm only (or primarily) when its valve is opening and closing. Accordingly, oil flow to each rocker arm is interrupted during each cycle when its valve is closed, but flow to the system should be continuous, since at least one valve will be opening or closing at all times. With this arrangement, total oil flow through the rocker arms will be reduced, compared to other systems, since little or no oil flows to any rocker arm during periods when its valve is closed. Therefore, a substantial reduction in the oil flow may be obtained while adequate oil is supplied during periods when the valve trains are moving and need lubrication.

Cylinder deactivation may be accomplished with a switching valve lifter, such as cam follower 14, which can be activated or deactivated by an oil pressure signal. However, other forms of cylinder deactivation may be provided. During deactivation, oil flow to the deactivated valve train assemblies 10 is restricted or cut off, further reducing the amount of oil flowing to the inactive cylinders, and reducing total engine oil flow even further. Thus, oil pressure for other engine requirements may be maintained with a smaller oil pump and parasitic losses will be further reduced.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A valve train for an internal combustion engine, the valve train comprising;

a cam having a base circle and a lobe extending from the base circle;

a cam follower engaging the cam for reciprocation in a guide; and a rocker arm operably engaged by the cam follower at a pivotable connection operative to pivot the rocker arm for opening and closing a valve;

the pivotable connection including lubrication passages which are aligned for lubricant flow from the cam follower to the rocker arm when the rocker arm is pivoted in a valve opening direction, the passages being at least partially misaligned when the rocker arm is in a valve closed position for limiting lubricant flow to the rocker arm when the valve is closed;

the cam follower being a switching hydraulic valve lifter capable of being deactivated so that the valve remains closed during engine operation and oil flow to the rocker arm in the valve closed position is at least substantially reduced.

2. A valve train as in claim 1 wherein a lubrication supply opening in a generally reciprocable component communicates with an inlet opening in the rocker arm, the communication being such that the openings are aligned during valve actuation and become misaligned when the valve is closed.

3. A valve train as in claim 1 wherein the pivotable connection is a spherical end and a socket.

4. A valve train as in claim 1 including a pushrod between the cam follower and the rocker arm wherein the pivotable connection is between the pushrod and the rocker arm.

5. A valve train as in claim 1 wherein misalignment of the passages in the pivotable connection stops the flow of lubrication to the rocker arm.

6. A valve train as in claim 1 wherein lubrication flow to the rocker arm is substantially cut off when the valve is closed.

* * * * *